United States Patent [19]

Atarashi et al.

[11] Patent Number: 5,064,346

[45] Date of Patent: Nov. 12, 1991

[54] IMPELLER OF MULTIBLADE BLOWER

[75] Inventors: Masahiro Atarashi, Kusatsu; Ito: Shotaro, Shiga; Kiyoshi Sano, Otsu; Yoshiaki Hayashi; Kenichi Uno, both of Gifu, all of Japan

[73] Assignees: Matsushita Electric Industrial Co., Ltd., Osaka; Pacific Industrial Company, Gifu, both of Japan

[21] Appl. No.: 523,179

[22] Filed: May 15, 1990

Related U.S. Application Data

[63] Continuation of Ser. No. 364,992, Jun. 12, 1989, abandoned.

[30] Foreign Application Priority Data

Jun. 17, 1988 [JP] Japan ..... 63-150786

[51] Int. Cl.[5] ..... F01D 5/14

[52] U.S. Cl. ..... 416/178; 416/223 B

[58] Field of Search ..... 416/178, 187, 203, 223 R, 416/223 B

[56] References Cited

U.S. PATENT DOCUMENTS

| | | | |
|---|---|---|---|
| 1,250,681 | 12/1917 | Sheldon | 416/178 X |
| 2,419,411 | 4/1947 | Mayne | 416/178 |
| 3,536,416 | 10/1970 | Glucksman | 416/178 |
| 4,538,963 | 9/1985 | Sugio et al. | 416/203 |

FOREIGN PATENT DOCUMENTS

| | | | |
|---|---|---|---|
| 326041 | 9/1920 | Fed. Rep. of Germany | 416/178 |
| 344746 | 11/1921 | Fed. Rep. of Germany | 416/178 |
| 466300 | 2/1928 | Fed. Rep. of Germany | 416/223 B |
| 844518 | 7/1952 | Fed. Rep. of Germany | 416/178 |
| 1280348 | 11/1961 | France | 416/178 |
| 228608 | 10/1985 | German Democratic Rep. | 416/132 A |
| 597 | 1/1981 | Japan | 416/179 |
| 59-167990 | 11/1984 | Japan . | |
| 17295 | 1/1985 | Japan | 416/187 |
| 60-17296 | 1/1985 | Japan . | |
| 60-12959 | 4/1985 | Japan . | |
| 365822 | 1/1963 | Switzerland | 416/178 |
| 1302030 | 4/1987 | U.S.S.R. | 416/223 B |
| 711667 | 7/1954 | United Kingdom | 416/223 B |

*Primary Examiner*—John T. Kwon

*Attorney, Agent, or Firm*—Stevens, Davis, Miller & Mosher

[57] ABSTRACT

An impeller of a multiblade blower having at least two circular end plates or partition plates spaced apart from each other, and a plurality of blades disposed between the peripheral portions of the partition plates. Each of the blades is formed with a cylindrical portion having a uniform cross-sectional area, at the outer peripheral end thereof on the outer peripheral side of the impeller. The cylindrical portion has a diameter which is larger than the thickness of the blade at the outer peripheral end thereof so that the cylindrical portion is projected from both front and rear surfaces of the blade at the outer peripheral end of the latter.

1 Claim, 6 Drawing Sheets

IMPELLER OF MULTIBLADE BLOWER

This application is a continuation of Ser. No. 364,992 filed June 12, 1989, now abandoned.

BACKGROUND OF THE INVENTION

This invention relates to an impeller such as a cross flow fan or sirocco fan of the type widely used as fans for air conditioners and other kinds of equipment.

Ordinarily, the construction of a cross flow fan, i.e., a kind of multiblade fan is like the one disclosed in Japanese Patent Unexamined Publication No. 60-17296 and Japanese Utility Model Unexamined Publication No. 59-167990.

That is, a cross flow fan has specific features unlike other types of fans whereby the direction in which air flows into the fan and the direction in which air flows out of the fan are generally reverse to each other, as indicated by the arrows in FIG. 1A, and the air flow rate can generally be increased in proportion to the axial length of the fan. For this reason, cross flow fans have recently come into wide use.

A technique of using a specific arrangement of impeller blades is known which resides in the fact that, as shown in FIG. 1B, impeller blades a are disposed at pitch angles determined on the basis of random numbers without any periodicity to reduce audible rotational noise (nz-sound, n: rotating speed, z: number of blades).

FIG. 2A shows an ordinary nz-sound frequency characteristic, and FIG. 8B shows an nz-sound frequency characteristic based on a random pitch arrangement of blades.

Japanese Utility Model Publication No. 60-12959 discloses the construction of a centrifugal fan.

FIG. 3 shows an example of this type of centrifugal fan which has a structure wherein fluid flows into the fan in the radial direction or obliquely at a fan inlet b and flows out in a spreading manner through an outlet c. This structure is suitable for use under high static pressures and high loads. A design in which each blade d is formed with an aerofoil section has also been adopted with a view to improving aerodynamic characteristics and flow rate characteristics.

Although the cross flow fan shown in FIG. 1 is designed to apparently reduce audible piping-like sounds by setting the pitch angles of the arrangement of the blades in an irregular manner so as to disperse the frequencies of nz-sounds as shown in FIG. 2B, n-sound (n: number of revolution) per one period becomes more sensible. This sound may increase the intensity of noise determined by the auditory sense, thereby impairing the noise reducing effects. Also, a problem of a reduction in the flow rate due to the irregularity of the blade pitch angles.

The centrifugal fan shown in FIG. 3 designed to improve efficiency by forming an aerofoil section of each blade may have a considerably large weight because the thickness of the blade is increased. If, on the other hand, a hollow blade structure is adopted, the number of manufacture steps is increased accordingly, resulting in an increase in the manufacture cost.

SUMMARY OF THE INVENTION

In view of these problems, an object of the present invention is to provide a low-cost and light weight multiblade fan improved in flow rate characteristics while reducing the intensity of fan noise based on the auditory sense.

To this end, the present invention provides an impeller for a multiblade blower having a cylindrical portion formed on an edge of each of blades at the inner peripheral side of the impeller so as to extend lengthwise of the blade, the diameter of the cylindrical portion being larger than the thickness of the corresponding edge of the blade.

In this arrangement, separation of air from each blade when the air moves across the region of the blade is limited by the effect of the cylindrical portion, thereby reducing wind-cut noise as well as n-sound. It is also possible to disperse stream vortexes.

DESCRIPTION OF THE PREFERRED EMBODIMENTS

Embodiments of the present invention will be described below with reference to the accompanying drawings.

An example of application of the present invention to a cross flow fan will first be described first with specific reference to FIGS. 4 to 6. The fundamental structure of a blower having a cross flow fan described herein is the same as the one shown in FIG. 1A and described below.

Figure 1A:
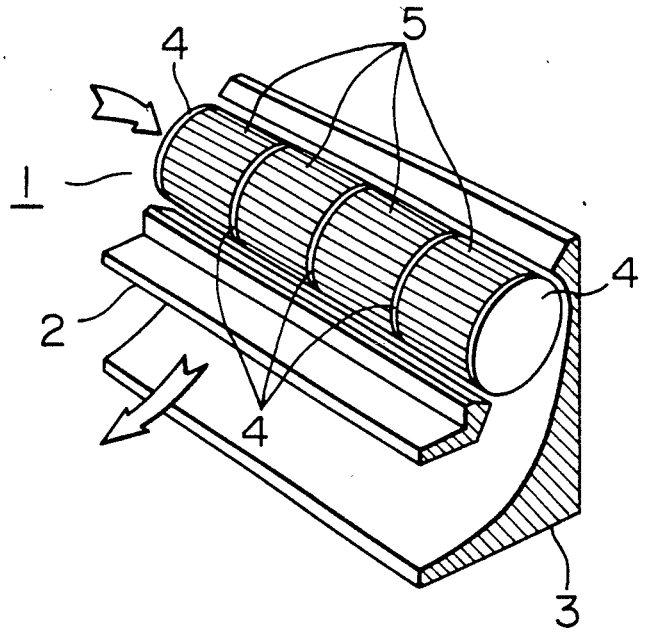
FIG. 1A is a perspective view of an ordinary cross flow blower partially cut off.
Figure 1B:
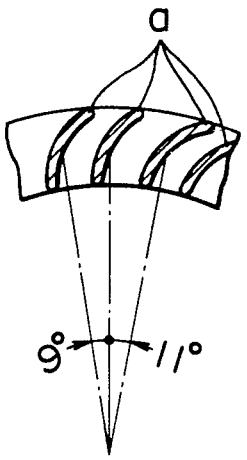
FIG. 1B is a cross-sectional view of essential portions of the fan shown in FIG. 1A.
Figure 2A:
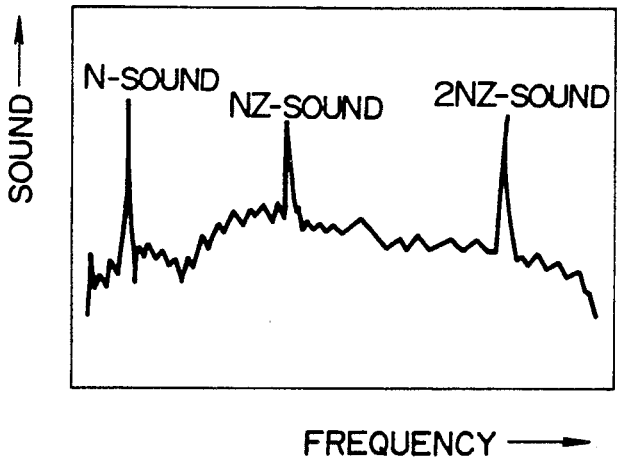
FIGS. 2A and 2B are diagrams of analysis of the frequencies of noise from blowers based on different conventional structures.
Figure 2B:
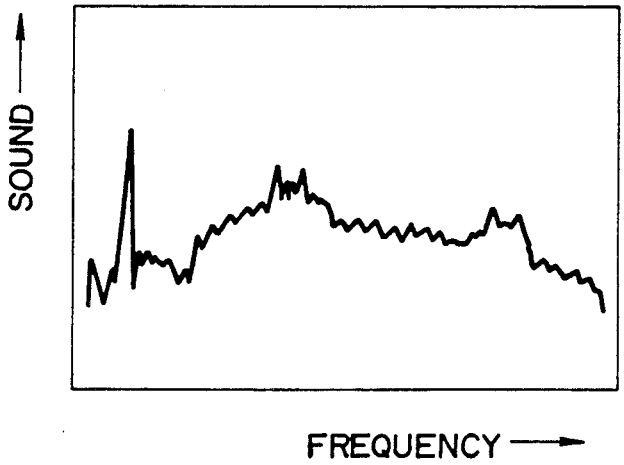
Figure 3:
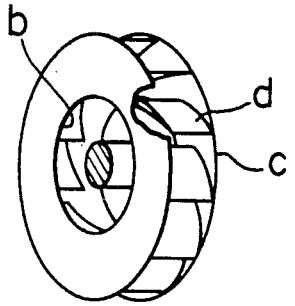
FIG. 3 is a perspective view of an example of another type of conventional impeller partially cut off.

A blower illustrated in FIG. 1A has a cross flow fan (hereinafter referred to as "impeller"), a stabilizer 2, a rear guider 3, partition plates 4 disposed at desired intervals, and blades 5 disposed between the partitions 4.

Figure 4:
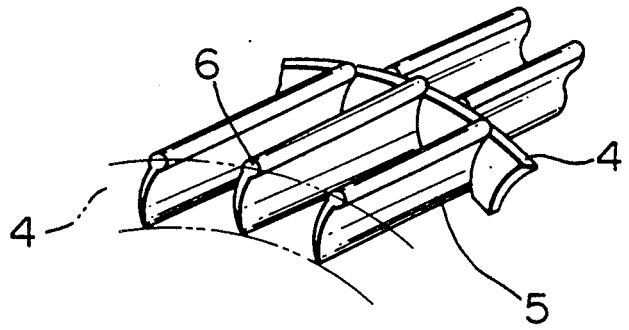
FIG. 4 is a perspective view of blades of a cross flow impeller in accordance with an embodiment of the present invention.

Referring to FIG. 4, a blade 5 of this embodiment has a cylindrical portion 6 formed at its one end corresponding to the outer peripheral side of the impeller so as to extend in the longitudinal direction of the blade 5. The diameter T of the cylindrical portion 6 is larger than the thickness t of the blade at the forward end thereof, as shown in FIG. 6.

Figure 5A:
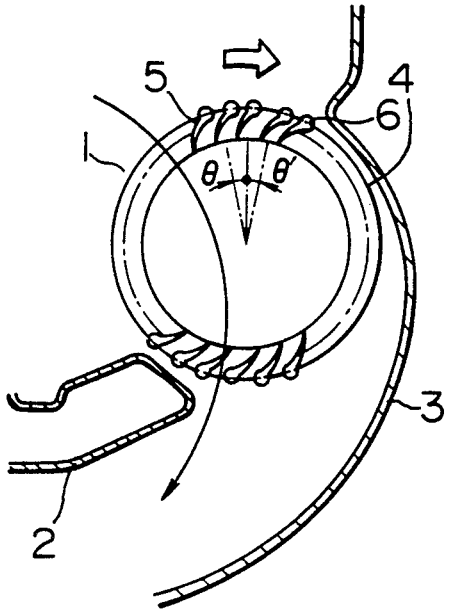
FIGS. 5A and 5B are cross-sectional views of a cross-flow blower having blades of the type shown in FIG. 4.
Figure 5B:
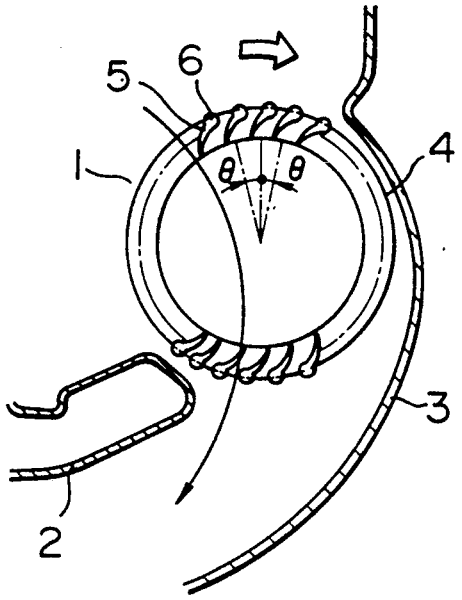
Figure 6:
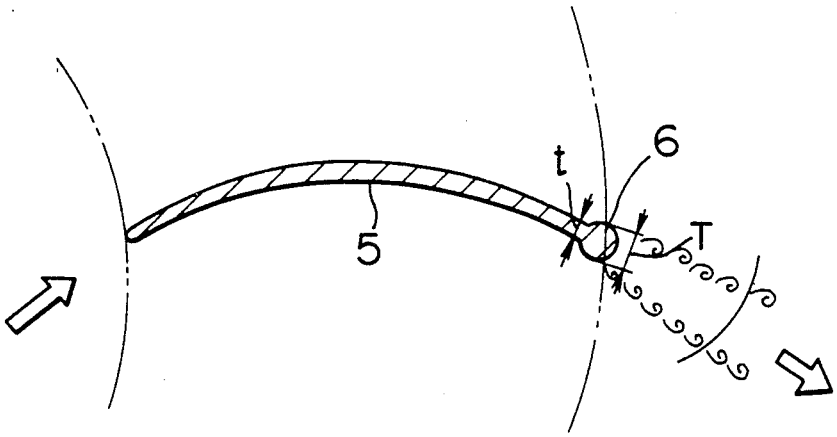
FIG. 6 is a diagram of a flow of air with respect to the blade shown in FIG. 4.

The thus-constructed blower may have an arrangement of the blades such as that shown in FIG. 5A in which the blades 5 are disposed with pitches based on random numbers (irregular intervals), or an arrangement such as that shown in FIG. 5B in which the blades 5 are disposed with equal pitches.

The state of air flows across the region of the blades 5 will be described below with reference to FIG. 6 in which the arrows represent flows of air.

Ordinarily, separation with formation of a turbulent boundary layer in the vicinity of the trailing edge of the blade 5, slip stream vortexes formed at the blade outlet, changes in the lift or pressure over the blade surface, and so on can be listed as causes of noise.

If a cylindrical portion 6 is formed on an edge of each blade corresponding to the outer periphery of the fan, the energy of a sound caused by cutting air flows by the edges of the blades at the drawing side decreases because the shape of such a cylindrical portion enables the blade to cut the air smoothly. Also, the provision of the cylindrical portion enables a reduction in changes in the flow velocity caused by variations in the dead water region due to fluctuations of the slip stream width when the blade moves across the air flow. At the same time, the regularity of occurrence of slip stream vortexes is thereby eliminated and the size of the vortexes is also dispersed, thereby limiting occurrence of sounds due to the vortexes.

Figure 7:
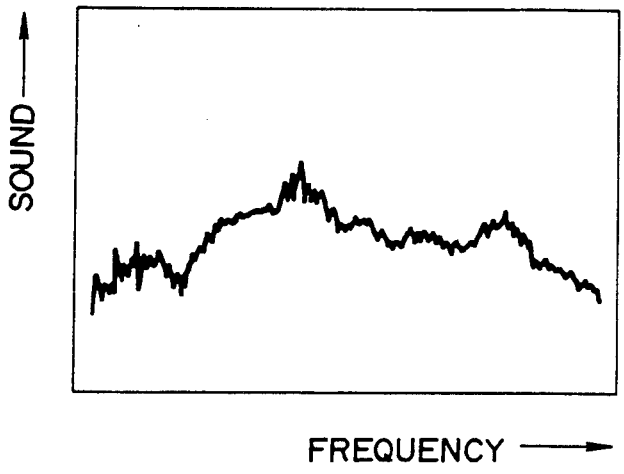
FIG. 7 is a diagram of analysis of the frequencies of noise from the blower having blades of the type shown in FIG. 4.

FIG. 7 shows a result of an experiment, i.e., analysis of the frequencies of noise generated from a cross flow fan having blades disposed in a random manner to which the present invention was applied.

As is apparent from FIG. 7, the magnitude of a low-frequency noise called as n-sound from the fan of the present invention was lower than that in the case of the conventional random fan with respect to the sound in a low-frequency range as called n-sound, as shown in Table 1.

This experiment was conducted as described below.

Specification of fan

Diameter of fan 86 mm

Number of blades: 36

Ratio of inside and outside diameters: about 0.79

Thickness of blade edge: 1.4 mm

Diameter of cylindrical portion 6: about 1 mm

Number of units: 8

TABLE 1

| Rotating speed rpm | Sound [dB] Conventional example | Sound [dB] Present invention |
|---|---|---|
| 1445 | 46.8 | 45.2 |
| 1200 | 41.0 | 39.1 |
| 1060 | 36.3 | 35.0 |
| 875 | 30.2 | 28.6 |

It was confirmed that the present invention was also effective with respective to the arrangement in which the blades 5 were disposed with equal pitches as shown in FIG. 5B.

Figure 8A:
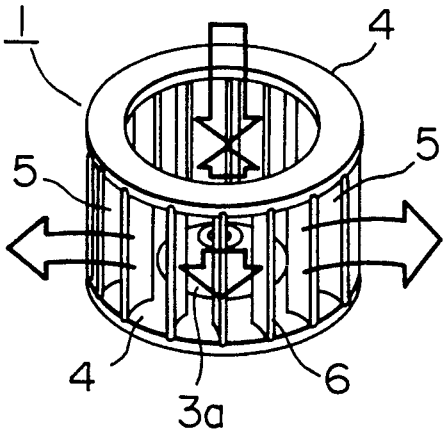
FIG. 8A is a perspective view of a centrifugal impeller in accordance with another embodiment of the present invention.
Figure 8B:
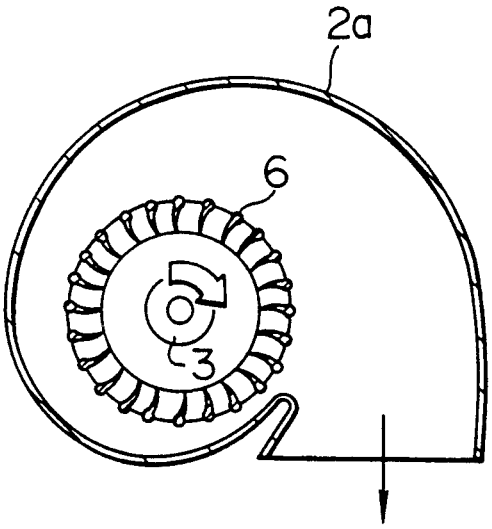
FIG. 8B is a cross-sectional view of a blower having blades of the type shown in FIG. 8A.

The present invention can also be applied in the same manner to a centrifugal blower such as that shown in FIG. 8.

In this arrangement, the impeller operates in such a manner that air flows into the impeller in the axial direction or obliquely and exits by spreading out in the radial direction as indicated by the arrows in FIG. 8, and the impeller has cylindrical portions formed at inner edges of blades 5. This arrangement enables the same effect as represented by the characteristic shown in FIG. 7.

The impeller 1 illustrated in FIG. 8 has a spiral casing 2a, a boss 3a, partition plates 4, blades 5 and cylindrical portions 6.

In the above-described embodiments, a cylindrical portion is formed on an edge of each of the blades at the outer peripheral side of the impeller, the diameter T of the cylindrical portion being larger than the thickness t of the corresponding edge of the blade 5, thereby limiting separation of air caused when the blade moves across the air flow at the outlet side of the blade 5. It is therefore possible to reduce the magnitude of noise due to separation and to reduce particular sounds such as n-sound and nz-sound which are essential audible sounds heard as noise.

Figure 9:
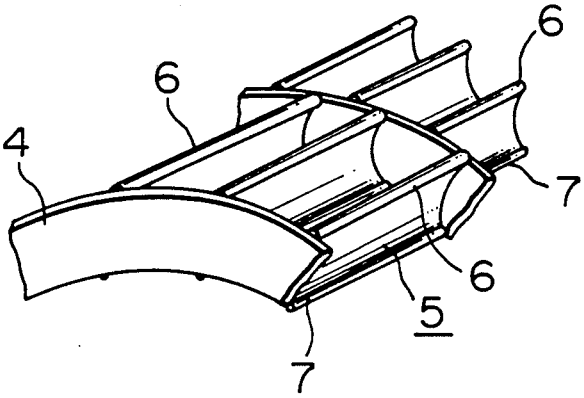
FIG. 9 is a perspective view of blades of an impeller in accordance with still another embodiment of the present invention.
Figure 10:
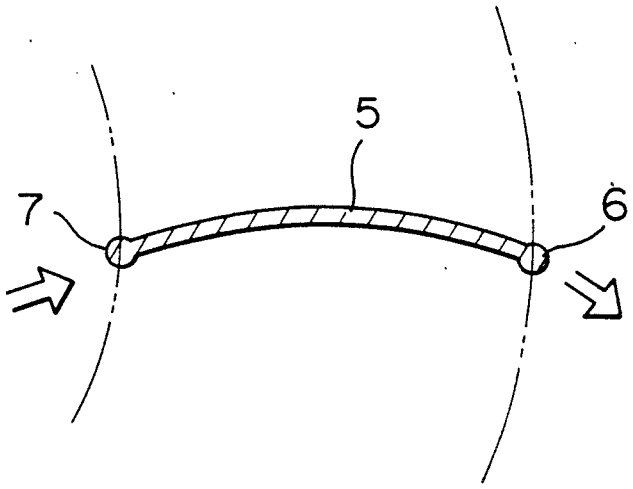
FIG. 10 is a diagram of a flow of air to the blade shown in FIG. 9.

Still another embodiment of the present invention will be described below with reference to FIGS. 9 to 11.

A multiblade impeller shown in these figures has partition plates 4, blades 5, cylindrical portions 6 formed on edges of the blades corresponding to the outer peripheral side of the impeller, and cylindrical portions 7 formed on the other edges of the blades 5 corresponding to the inner peripheral side of the impeller. Each of the cylindrical portions 6 and 7 has a diameter larger than the thickness of the corresponding edge of the blade. Each of the cylindrical portions 6 and 7 extends lengthwise of the blade 5 as in the case of the above-described embodiments.

Air flows across the region of the blades 5 will be described below with reference to FIG. 10.

In the conventional arrangement, wind-cut noise (aerodynamic noise) or edge tone is generated at the inlet side when the blades move across air flows, or flow rate characteristics are considerably impaired due to inflow impact losses.

To cope with this problem, the cylindrical portion 7 is formed at the inner peripheral end of each blade 5 in addition to the cylindrical portions 6 of the above-described embodiments, thereby ensuring that separation can be prevented even though, a slight difference exists between the direction in which the air is drawn into the impeller and the direction of the blade inlet angle. The reduction in the blowing efficiency due to separation and occurrence of noise are thereby limited.

Figure 11:
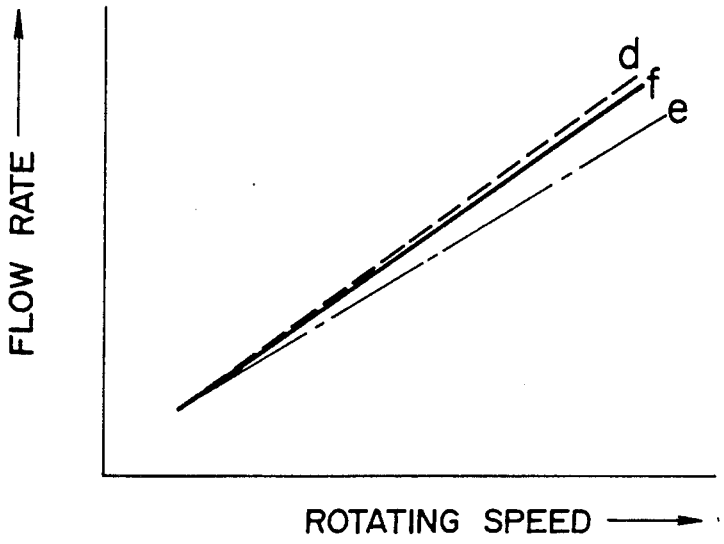
FIG. 11 is a diagram of characteristics of a blower having blades of the type shown in FIG. 9 and the conventional blower.

FIG. 11 shows a graph of comparison between flow rate characteristics of the conventional cross flow blower structure and the present invention obtained as a result of experiment.

In FIG. 11, a reference character e designates a fan having blades disposed at random pitch angles, a reference character d a fan having blades disposed at equal pitch angles, and a reference character f the fan in accordance with the present invention having blades disposed at random pitch angles and having circular portions 6 and 7 formed on the blades.

As can be understood from FIG. 11, the higher the rotating speed, the lower the flow rate would be in the ordinary random fan in comparison with the case of the equal pitch fan.

However, the arrangement in accordance with the present invention in which cylindrical portions 6 and 7 were formed at the inner peripheral side of the random fan enabled flow rate characteristics substantially the same as the equal pitch arrangement, thus improving the blowing performance.

The process and the results of the experiment were as follows.

Specification of fan

Diameter of fan: 86 mm

Number of blades: 36

Ratio of inside and outside diameters: about 0.79

Thickness of blade edge: about 0.5 mm

Diameter of cylindrical portion 6: about 1 mm

Diameter of cylindrical portion 7: about 1 mm

Number of units: 8

TABLE 2

| Rotating speed (rpm) | Flow rate [$m^3$/sec] | | Sound [dB] | |
|---|---|---|---|---|
| | Conventional example | Present invention | Conventional example | Present invention |
| 1445 | 9.7 | 9.77 | 46.6 | 45.4 |
| 1200 | 7.8 | 7.66 | 41.0 | 39.6 |
| 1060 | 6.5 | 6.51 | 36.3 | 35.1 |
| 875 | 5.0 | 5.0 | 30.2 | 29.0 |

Thus, it is possible to improve the flow rate characteristics as well as to reduce the noise by forming, on opposite edges of each blade 5, the cylindrical portions 6 and 7 having a diameter larger than the thickness of the blade 5 lengthwise thereof. Each blade can be formed with the desired aerofoil section while limiting the increase in the weight and the manufacture cost.

It is apparent that the present invention can also be applied in the same manner to a centrifugal blower such as that shown in FIG. 8.

In the above-described embodiments, the cross-flow fan has a plurality of units separated by the partition plates 4 arranged in the axial direction. It is of course possible that the present invention enables similar effects when applied to a single unit arrangement.

As is apparent from the above-described embodiments, in the impeller of the multiblade blower in accordance with the present invention, a cylindrical portion is formed on an edge of each of the blades at the outer peripheral side of the impeller so as to extend through the overall length of the blade and to have a diameter larger than the thickness of the edge of the blade, thereby reducing the magnitudes of specific n-sound and nz-sound peculiar to conventional impellers and improving noise characteristics.

In addition, similar cylindrical portions can also be formed on the other edge of the blades corresponding to the inner peripheral side of the impeller, thereby enabling improvements in both nose characteristics and flow rate characteristics.

What is claimed is:

1. An impeller of a multiblade blower having an outer peripheral side and at least two circular end plates or partition plates spaced apart from each other, said plates each having an outer peripheral portion, and a plurality of blades disposed between said outer peripheral portions of said partition plates and each of said blades having an outer peripheral end, front and rear surfaces and a thickness, said each blade being formed with a cylindrical portion having a uniform cross-sectional area at said outer peripheral end thereof on the outer peripheral side of said impeller so as to extend through the overall length of said blade, said cylindrical portion having a diameter which is larger than the thickness of said blade at said outer peripheral end thereof, and said cylindrical portion being projected from both front and rear surfaces of said blade at said outer peripheral end of the same.

* * * * *